US008740054B2

(12) United States Patent
Pinkstone

(10) Patent No.: US 8,740,054 B2
(45) Date of Patent: Jun. 3, 2014

(54) CONVERTIBLE SHIPPING AND DISPLAY CARTON

(75) Inventor: Felicia A. Pinkstone, Aston, PA (US)

(73) Assignee: Graphic Packaging International, Inc., Marietta, GA (US)

( * ) Notice: Subject to any disclaimer, the term of this patent is extended or adjusted under 35 U.S.C. 154(b) by 207 days.

(21) Appl. No.: 13/274,551

(22) Filed: Oct. 17, 2011

(65) Prior Publication Data

US 2012/0091031 A1 Apr. 19, 2012

Related U.S. Application Data

(60) Provisional application No. 61/455,296, filed on Oct. 18, 2010.

(51) Int. Cl.
*B65D 5/42* (2006.01)
*B65D 5/00* (2006.01)

(52) U.S. Cl.
USPC ..... 229/242; 229/103; 206/736

(58) Field of Classification Search
USPC ..... 229/242, 919, 235, 177, 179, 187, 118, 229/210, 224, 212, 225, 238, 207, 208, 223, 229/221; 206/736, 774, 429, 431
See application file for complete search history.

(56) References Cited

U.S. PATENT DOCUMENTS

| | | | |
|---|---|---|---|
| 1,656,919 | A | 1/1928 | Marsh |
| 1,901,483 | A | 3/1933 | Ware, Jr. |
| 1,925,102 | A | 9/1933 | Levkoff |
| 2,027,079 | A | 1/1936 | Weiss |
| 2,141,743 | A | 12/1938 | Ethridge |
| 2,145,430 | A | 1/1939 | New |
| 2,152,079 | A | 3/1939 | Mott |
| 2,684,178 | A | 7/1954 | Keeler |
| 2,704,617 | A | 3/1955 | Stieve |
| 3,002,613 | A | 10/1961 | Merkel et al. |
| 3,258,152 | A | 6/1966 | Cameron |
| 3,276,665 | A | 10/1966 | Rasmussen |
| 3,280,968 | A | 10/1966 | Craine |
| 3,511,434 | A | 5/1970 | Dews |
| 3,554,402 | A | 1/1971 | Lock |
| 3,578,238 | A | 5/1971 | Schillinger et al. |
| 3,653,495 | A | 4/1972 | Gray |
| 3,677,458 | A | 7/1972 | Gosling |
| 3,688,972 | A | 9/1972 | Mahon |

(Continued)

FOREIGN PATENT DOCUMENTS

| | | |
|---|---|---|
| DE | 2 320 190 | 11/1973 |
| EP | 0 704 386 A1 | 4/1996 |

(Continued)

*Primary Examiner* — Gary Elkins
*Assistant Examiner* — Christopher Demeree
(74) *Attorney, Agent, or Firm* — Womble Carlyle Sandridge & Rice, LLP

(57) ABSTRACT

A carton includes a front wall and a back wall opposite one another, and a first side wall and a second side wall opposite one another, where the front wall and back wall are joined to the first side wall and second side wall along reinforced corner areas, each of which includes an interior reinforcing flap and an exterior reinforcing flap. The carton further includes a line of disruption extending at least partially across the front wall, first side wall, and second side wall, where the line of disruption at least partially defines a removable portion of the carton.

27 Claims, 4 Drawing Sheets

(56) References Cited

U.S. PATENT DOCUMENTS

| | | | | | |
|---|---|---|---|---|---|
| 3,759,378 | A | | 9/1973 | Werth | |
| 3,786,914 | A | | 1/1974 | Beutler | |
| 3,833,116 | A | | 9/1974 | Howe | |
| 3,884,348 | A | | 5/1975 | Ross | |
| 3,904,036 | A | | 9/1975 | Forrer | |
| 4,008,849 | A | | 2/1977 | Baber | |
| 4,039,120 | A | | 8/1977 | Herzog | |
| 4,058,206 | A | * | 11/1977 | Morse et al. | 229/241 |
| 4,113,100 | A | | 9/1978 | Soja et al. | |
| 4,201,322 | A | | 5/1980 | Crawford | |
| 4,295,598 | A | | 10/1981 | Calvert | |
| 4,327,829 | A | | 5/1982 | Hughes | |
| 4,533,052 | A | | 8/1985 | Fruchey et al. | |
| 4,550,834 | A | * | 11/1985 | Fletcher et al. | 229/207 |
| 4,558,785 | A | | 12/1985 | Gordon | |
| 4,742,917 | A | | 5/1988 | Bornwasser | |
| 4,773,541 | A | | 9/1988 | Riddell | |
| 4,815,609 | A | | 3/1989 | Kiedaisch | |
| 4,886,160 | A | | 12/1989 | Kligerman | |
| 5,029,698 | A | | 7/1991 | Stout | |
| 5,065,937 | A | | 11/1991 | Ritter | |
| 5,156,269 | A | | 10/1992 | Bakx | |
| 5,167,324 | A | * | 12/1992 | Miller | 206/738 |
| 5,181,650 | A | | 1/1993 | Hollander et al. | |
| 5,197,598 | A | | 3/1993 | Stout et al. | |
| 5,246,112 | A | | 9/1993 | Stout et al. | |
| 5,400,955 | A | | 3/1995 | Coalier et al. | |
| 5,582,345 | A | | 12/1996 | Lankhuijzen | |
| 5,588,585 | A | | 12/1996 | McClure | |
| 5,647,483 | A | | 7/1997 | Harris | |
| 5,699,957 | A | | 12/1997 | Blin et al. | |
| 5,704,470 | A | | 1/1998 | Sutherland | |
| 5,842,576 | A | | 12/1998 | Snow | |
| 5,857,570 | A | | 1/1999 | Brown | |
| 5,881,884 | A | * | 3/1999 | Podosek | 206/774 |
| 5,921,398 | A | | 7/1999 | Carroll | |
| 5,927,498 | A | | 7/1999 | Saam | |
| 5,941,377 | A | | 8/1999 | Hart et al. | |
| 5,979,749 | A | | 11/1999 | Bozich | |
| 6,041,920 | A | | 3/2000 | Hart et al. | |
| 6,105,853 | A | | 8/2000 | Lamare | |
| 6,129,211 | A | | 10/2000 | Prakken et al. | |
| 6,135,289 | A | | 10/2000 | Miller | |
| 6,227,367 | B1 | | 5/2001 | Harrelson et al. | |
| 6,332,538 | B1 | * | 12/2001 | Pritchard | 206/524.3 |
| 6,419,152 | B1 | | 7/2002 | Tokarski | |
| 6,435,351 | B1 | | 8/2002 | Gibb | |
| 6,478,159 | B1 | | 11/2002 | Taylor et al. | |
| 6,510,982 | B2 | | 1/2003 | White | |
| 6,523,692 | B2 | | 2/2003 | Gregory | |
| 6,536,656 | B2 | | 3/2003 | Auclair et al. | |
| 6,631,803 | B2 | | 10/2003 | Rhodes et al. | |
| 6,695,137 | B2 | | 2/2004 | Jones et al. | |
| 6,729,475 | B2 | * | 5/2004 | Yuhas et al. | 206/746 |
| 6,869,009 | B2 | | 3/2005 | Sutherland et al. | |
| 6,968,992 | B2 | | 11/2005 | Schuster | |
| 6,981,632 | B2 | | 1/2006 | Gardner et al. | |
| 7,118,023 | B2 | | 10/2006 | Holdsworth | |
| 7,128,206 | B2 | | 10/2006 | Kohler | |
| 7,152,777 | B2 | | 12/2006 | McClure | |
| 7,225,930 | B2 | | 6/2007 | Ford et al. | |
| 7,552,820 | B2 | | 6/2009 | Kohler | |
| 7,959,063 | B2 | | 6/2011 | McLeod | |
| 2002/0043554 | A1 | | 4/2002 | White | |
| 2002/0170845 | A1 | | 11/2002 | Oliff | |
| 2003/0222131 | A1 | | 12/2003 | Justice | |
| 2004/0124111 | A1 | | 7/2004 | Bevier | |
| 2005/0103651 | A1 | | 5/2005 | Lebras | |
| 2005/0211577 | A1 | | 9/2005 | Bakx | |
| 2005/0230273 | A1 | | 10/2005 | Kohler | |
| 2006/0006216 | A1 | | 1/2006 | Moll et al. | |
| 2006/0138206 | A1 | | 6/2006 | Keefe et al. | |
| 2006/0231603 | A1 | | 10/2006 | McLeod | |
| 2009/0266873 | A1 | | 10/2009 | Ledvina | |
| 2010/0308104 | A1 | | 12/2010 | Kohler | |
| 2012/0091031 | A1 | | 4/2012 | Pinkstone | |

FOREIGN PATENT DOCUMENTS

| | | | |
|---|---|---|---|
| FR | 1 379 931 | | 11/1964 |
| GB | 1 218 016 | | 1/1971 |
| WO | WO 99/31593 | | 7/1998 |
| WO | WO 03/082686 | A1 | 10/2003 |
| WO | WO 2004/063031 | A1 | 7/2004 |

* cited by examiner

CONVERTIBLE SHIPPING AND DISPLAY CARTON

CROSS-REFERENCE TO RELATED APPLICATION

This application claims the benefit of U.S. Provisional Application No. 61/455,296, filed Oct. 18, 2010, which is incorporated by reference herein in its entirety.

TECHNICAL FIELD

This application is directed generally to a carton for holding one or more articles. The carton may be converted to a display for displaying the articles.

SUMMARY

This application is directed generally to a carton for holding a plurality of articles. The carton may be transformed into a display for holding the articles, for example, a retail display.

The carton may include an easy open feature that facilitates the transformation of the shipping carton into the display without the need for a cutting implement. The edges of the display may generally be soft and clean (i.e., not rough or jagged) for consumer safety.

The carton may include reinforced (i.e., double wall) corners to add strength and/or crush resistance to the carton and/or display. The use of the reinforced corners may allow for lighter materials to be used, as compared with a similar carton or display without reinforced corners.

The carton may be formed of any suitable material, for example, paperboard, and may be printed if desired.

Additional features, aspects, and embodiments will become apparent in view of the following description and accompanying figures.

BRIEF DESCRIPTION OF THE DRAWINGS

The description refers to the accompanying drawings in which like reference characters refer to like parts throughout the several views, and in which.

DESCRIPTION

Figure 1A:
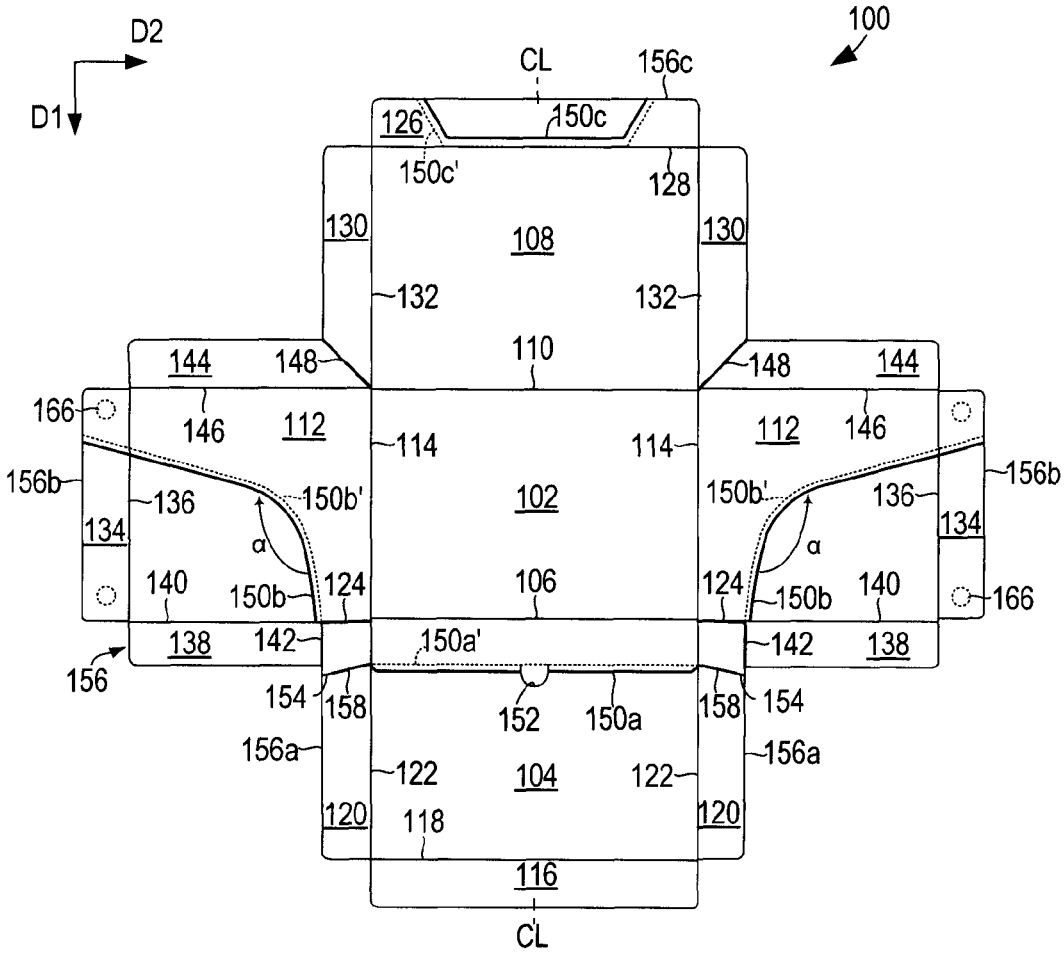
FIG. 1A is a schematic top plan view of a first side of an exemplary blank for forming a convertible carton, the illustrated side of the blank defining at least a portion of the interior side of the carton.
Figure 1B:
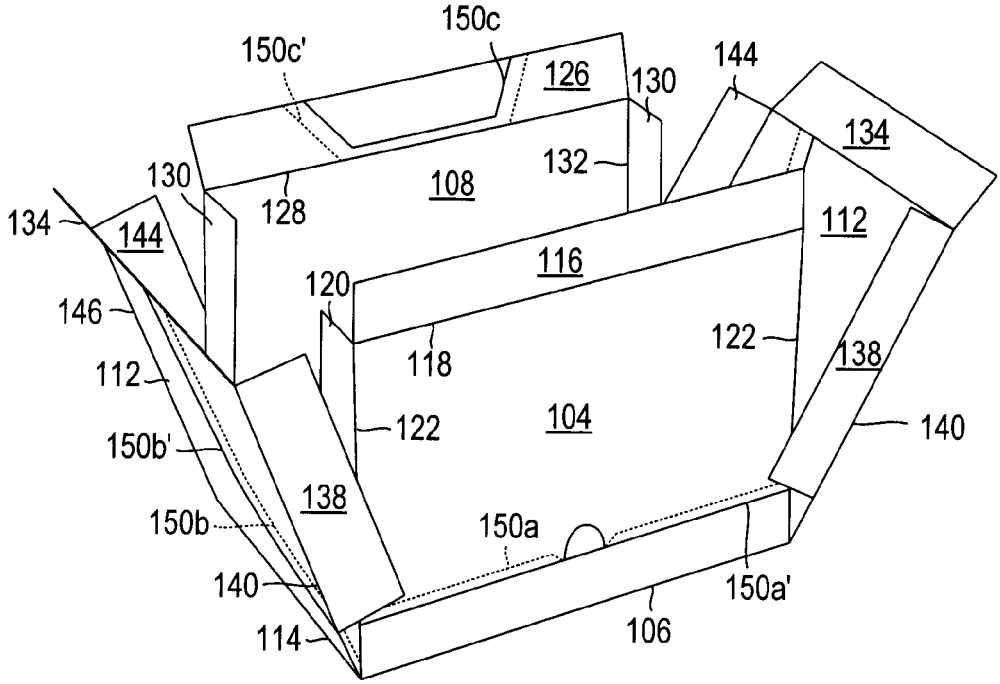
FIG. 1B is a schematic perspective view of a carton formed from the blank of FIG. 1A, in a partially erected configuration.
Figure 1C:
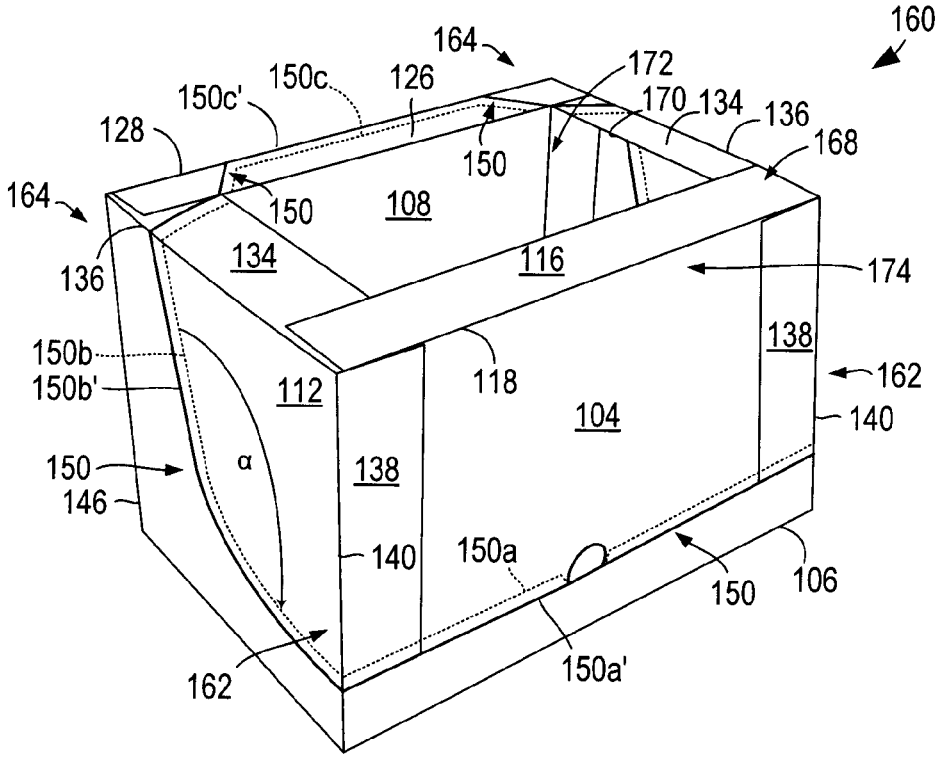
FIG. 1C is a schematic perspective view of a carton formed from the blank of FIG. 1A, in a fully erected configuration.

FIG. 1A schematically depicts a top plan view of one side (e.g., an interior side) of a blank 100 for forming a convertible carton 160 (FIG. 1C). The carton 160 is illustrated in a first configuration for containing a plurality of articles in FIG. 1C, and a second configuration for displaying the articles in FIGS. 1F and 1G.

As shown in FIG. 1A, the blank 100 includes a plurality of panels joined at or along their respective edges along lines of weakening or disruption, for example, fold lines, tear lines, score lines, cuts (e.g. slits), kiss cut lines, or any other lines of weakening or disruption, or any combination thereof. The blank 100 and each of the various panels, lines of disruption, and other features generally have a first dimension, for example, a length, extending in a first direction, for example, a longitudinal direction, D1, and a second dimension, for example, a width, extending in a second direction, for example, a transverse direction, D2. It will be understood that such designations are made only for convenience and do not necessarily refer to or limit the manner in which the blank is manufactured or erected into the construct. The blank 100 may be symmetric or nearly symmetric about a longitudinal centerline CL. Therefore, certain elements in the drawing figures may have similar or identical reference numerals to reflect the whole or partial symmetry.

As shown in FIG. 1A, the blank 100 includes a bottom panel 102, a front panel 104 joined to the bottom panel 102 along a transverse line of disruption, for example, fold line 106, a back panel 108 joined to the bottom panel 102 along a transverse line of disruption, for example, fold line 110, and a pair of side panels 112 joined to the bottom panel 102 along respective longitudinal lines of disruption, for example, fold lines 114. Fold lines 106, 110 are parallel to one another and fold lines 114 are parallel to one another, such that the bottom panel 102 is generally rectangular in shape. However, other shapes are contemplated.

An end flap (or front panel end flap) 116 is joined to the front panel 104 along a transverse line of disruption, for example, fold line 118. A pair of side flaps (or front panel side flaps) 120 is joined to the front panel 104 along respective longitudinal lines of disruption, for example, fold lines 122. Side flaps 120 are separated from side panels 112 by respective transverse lines of disruption, for example, cuts 124. End flap 116 and side flaps 120 are substantially rectangular in shape. However, other shapes are contemplated. Further, it will be noted that the use of the terms "end" and "side" throughout this specification is not intended to convey any relative size difference between the various panels or flaps. Side flaps 120 serve as reinforcing flaps in the erected construct 160 (FIG. 1C), as will be discussed further below.

Likewise, an end flap (or back panel end flap) 126 is joined to the back panel 108 along a transverse line of disruption, for example, fold line 128. A pair of side flaps (or back panel side flaps) 130 is joined to the back panel 108 panel along respective longitudinal lines of disruption, for example, fold lines 132. End flap 126 is substantially rectangular in shape. Side flaps 130 are substantially rectangular in shape with a clipped or chamfered end or corner adjacent to the bottom panel 102. However, other shapes are contemplated. Side flaps 130 serve as reinforcing flaps in the erected construct 160 (FIG. 1C), as will be discussed further below.

An end flap (or side panel end flap) 134 is joined to each side panel 112 along a respective longitudinal line of disruption, for example, fold line 136. Further, a first side flap (or first side panel end flap) 138 is joined to each side panel 112 along a respective transverse line of disruption, for example, fold line 140. Side flap 138 is substantially rectangular in shape and separated from the adjacent side flap 120 joined to the front panel 104 by a longitudinal line of disruption, for example, cut 142. Additionally, a second side flap (or second side panel end flap) 144 is joined to each side panel 112 along a respective transverse line of disruption, for example, fold line 146. Side flap 144 is substantially rectangular in shape with a clipped or chamfered end or corner adjacent to the bottom panel 102 and/or back panel side flaps 130. However, other shapes are contemplated. Each side flap 144 is separated from the adjacent back panel side flap 130 by a respective oblique line of disruption, for example, cut 148. Side flaps 138, 144 serve as reinforcing flaps in the erected construct 160 (FIG. 1C), as will be discussed further below.

As shown in FIG. 1A, the blank 100 further includes a plurality of lines of disruption that collectively define a removable portion 174 of the carton 160 (FIG. 1C) erected from the blank 100, as will be discussed further below. In the illustrated embodiment, the lines of disruption comprise kiss cut lines, i.e., cuts or scores, or more specifically slits, that extend only partially though the thickness of the blank. The kiss cut lines may be arranged in pairs (e.g., 150*a* and 150*a*', 150*b* and 150*b*', 150*c* and 150*c*', etc.) offset from and extending along one another on opposite sides of the blank 100 to define a kiss cut area between the pair of kiss cut lines. The offset kiss cut lines within each pair of offset kiss cut lines cooperate with one another to function like a tear line, with the thickness of the panel in the kiss cut area being divided (e.g., separated into two sections that are each about one-half the thickness of the panel) when the offset kiss cut lines are breached. In FIG. 1A, the kiss cut lines (e.g., 150*a*, 150*b*, 150*c*) on the illustrated side of the blank 100 are shown as solid lines, while the kiss cut lines (e.g., 150*a*', 150*b*', 150*c*') on the opposite side of the blank 100 are shown schematically with dashed lines. The kiss cut lines may be substantially continuous (as shown) or may comprise a plurality of spaced apart lines of weakening or disruption that resemble a conventional tear line.

Other types of lines of disruption may be used. For example, one or more pairs of offset kiss cut lines may be replaced with other types of tear lines.

Viewing the illustrated embodiment 100 in greater detail, a line of disruption, for example, kiss cut line 150*a*, extends at least partially across, and in this case, substantially across the front panel 104 between longitudinal fold lines 122. Kiss cut 150*a* includes a central portion extending substantially in the transverse direction D2 and a pair of end portions (e.g., oblique end portions) that extend obliquely and outwardly in a direction towards the bottom panel 102 and substantially abut fold lines 122. The central portion of the kiss cut 150*a* may be substantially parallel to fold line 106. On an opposite side of the blank (not shown), a line of disruption, for example, kiss cut line 150*a*', extends substantially between opposite ends of kiss cut 150*a* along fold lines 122. If desired, a cutout or access opening 152 may be adjacent to or interrupt the transverse portion of kiss cut 150*a*. In this example, the access opening 152 is substantially arcuate or semi-circular in shape, with its ends substantially abutting kiss cut 150*a*'. However, other shapes and configurations are contemplated.

If desired, a pair of lines of disruption, for example, fold lines 154, may extend obliquely (in a direction away from the bottom panel 102) substantially between the ends of kiss cut 150*a* across the front panel side flaps 120 to a longitudinal peripheral edge 156*a* of side flaps 120. If desired, each fold line 154 may be interrupted by a cut 158 (e.g., a slit) extending substantially from fold line 122 partially along the length of oblique fold line 154. In an alternate embodiment, fold lines 154 may be replaced with cuts (e.g., slits).

Additionally, lines of disruption, for example, kiss cuts 150*b*, may extend substantially from transverse fold lines 140 to respective longitudinal peripheral edges 156*b* of side panel end flaps 134. Kiss cuts 150*b* have a generally curved shape, somewhat resembling a sideways L, except that the "legs" or portions of the L may, in some embodiments generally define an oblique angle $\alpha$ instead of a right angle (in other embodiments, a may be 90 degrees). For each of the kiss cuts 150*b*, a first, somewhat longitudinal portion extends slightly obliquely outwardly from fold line 140 (in a direction away from the bottom panel 102) and a second, oblique portion extends obliquely and outwardly from the longitudinal portion (in a direction towards side flap 144) towards and substantially abutting the respective longitudinal peripheral edge 156*b* of end flaps 134. On the opposite side of the blank (not shown), a line of disruption, for example, kiss cut 150*b*', having the same general shape as kiss cut 150*b*, extends substantially from fold line 140 (substantially from cut 142 and/or the endpoint of cut 124) to the respective longitudinal peripheral edge 156*b* of end flaps 134. However, other shapes are contemplated.

Still viewing FIG. 1A, the back panel end flap 126 includes a line of disruption, for example, kiss cut 150*c*. Kiss cut 150*c* includes a substantially transverse central portion substantially parallel to fold line 128 and a pair of end portions that extend obliquely and outwardly (in a direction towards back panel side flaps 130) and substantially abut a transverse peripheral edge 156*c* of the back panel end flap 126, such that the area defined by the kiss cut is substantially trapezoidal in shape. However, other shapes are contemplated. On the opposite side of the blank (not shown), a line of disruption, for example, kiss cut 150*c*', has the same general shape as kiss cut 150*c*, with the transverse portion of 150*c*' disposed substantially along fold line 128.

It will be noted that although some specific peripheral edges 156*a*, 156*b*, 156*c* of the blank 100 are discussed in detail herein, each of such peripheral edge portions 156*a*, 156*b*, 156*c* may comprise portions of a peripheral edge 156 of the blank. The peripheral edge 156 may include countless other portions including transverse portions, longitudinal portions, and oblique portions and/or may generally describe the entire peripheral edge of the blank and/or sections thereof.

As generally shown in FIG. 1B, to form the blank 100 into a carton 160 (FIG. 1C) according to one exemplary method, panels 104, 108 may be folded towards the bottom panel 102 along fold lines 106, 110 until panels 104, 108 are upright. Side flaps 120, 130 may be folded inwardly along fold lines 122, 132. Side panels 112 may be folded towards upright panels 104, 108 along fold lines 114. Side flaps 138, 144 may be folded towards side panels along fold lines 140, 146 so that the interior surface of side flaps 138, 144 is in contact with the exterior surface of panels 104, 108, and such that the exterior surface of side flaps 120, 130 is in contact with the interior surface of panels 112. Side flaps 138, 144 may be glued or otherwise joined to panels 104, 108, and side flaps 120, 130 may be glued or otherwise joined to side panels 112. Notably, the overlapping and joining of side flaps 138 with panel 104 and side flaps 120 with panel 112 define front reinforced corners 162 of the carton 160 (FIG. 1C). Similarly, the overlapping and joining of side flaps 144 with panel 108 and side flaps 130 with panel 112 define back (or rear) reinforced corners 164 of the carton 160 (FIG. 1C).

Further, as the blank 100 is folded as described above, the adjacent ends of lines of disruption 150*a*' and 150*b*' (i.e., end of line of disruption 150*a*' along fold line 122 and end of line of disruption 150*b*' along fold line 140) are brought into a substantially end to end relationship with one another on the exterior side of the carton 160. The adjacent ends of lines of disruption 150*a* and 150*b* (i.e., end of line of disruption 150*a* along fold line 122 and end of line of disruption 150*b* along fold line 140) are brought into a substantially end to end relationship with one another on the interior side of the carton 160. Line of disruption 154 and cut 158 are brought into substantial alignment with line of disruption 150*b*.

Likewise, the end of each line of disruption 150*b* along peripheral edge 156*b* is brought into a substantially end to end relationship with the adjacent end of line of disruption 150*c* along peripheral edge 156*c*, and the end of line of disruption 150*b*' along peripheral edge 156*b* is brought into a substantially end to end relationship with the adjacent end of line of disruption 150*c*' along peripheral edge 156*c*.

Thus, in the erected carton 160 (FIG. 1C), lines of disruption 150*a*, 150*b*, 150*c* are substantially coterminous with one another and lines of disruption 150*a*', 150*b*', 150*c*' are substantially coterminous with one another, such that the various lines of disruption 150*a*, 150*a*', 150*b*, 150*b*', 150*c*, 150*c*' may collectively define a line of disruption 150. However, although line of disruption 150 may be substantially continuous, various portions of the line of disruption 150 may be discussed for purposes of explanation, and not limitation.

As shown in FIG. 1C, which schematically illustrates the carton 162 in a fully erected configuration, end flaps 134 may be folded towards one another along fold lines 136, which also define top end edges of side walls 112. End flaps 116, 126 may then be folded towards one another along fold lines 118, 128 (which define top end edges of the front and back walls 104, 108) so that the interior surface of end flaps 116, 126 is in contact with the exterior surface of opposite marginal end areas of end flaps 134. End flaps 116, 126 may be adhesively joined to end flaps 134 at exemplary glue areas 166 (FIG. 1A). However, the flaps may be joined to one another in any other suitable manner.

The erected carton 160 generally includes a plurality of panels or walls including a front panel or wall 104 and a back panel or wall 108 opposite one another, and a pair of opposed side panels or walls 112 (e.g., a first side panel or wall 112 and a second side panel or wall 112) opposite one another. The front wall 104 and back wall 108 are joined to the first side wall 112 and second side wall 112 along front and back reinforced corner areas 162, 164, where each reinforced corner area generally includes a respective interior reinforcing flap 120, 130 and a respective exterior reinforcing flap 138, 144.

More particularly, in the illustrated embodiment, the carton 160 includes a pair of reinforcing flaps 138, 144 (e.g., a first reinforcing flap 138 and a second reinforcing flap 144) foldably joined or connected to each side wall 112. The first reinforcing flap 138 of each side wall 112 is joined to the exterior surface of the front wall 104 (e.g., joined to opposite marginal areas of the front wall 104 proximate to fold lines 122), for example, using an adhesive, to serve as exterior reinforcing flaps 138 for the front wall 104. Likewise, the second reinforcing flap 144 of each side wall 112 is joined to the exterior surface of the back wall 108 (e.g., joined to opposite marginal areas of the back wall 108 proximate to fold lines 132), for example, using an adhesive, to serve as exterior reinforcing flaps 144 for the back wall 108.

The carton 160 also includes a pair of reinforcing flaps 120, 130 (e.g., a first reinforcing flap and a second reinforcing flap) respectively foldably joined or connected to each of the front wall 104 and the back wall 108. The reinforcing flaps 120, 130 of the front wall 104 and the back wall 108 are joined to the interior surface of the side walls 112 (e.g., joined to opposite marginal areas of the side walls 112 proximate to fold lines 140, 146), for example, using an adhesive, to serve as interior reinforcing flaps 120, 130 for the side walls 112.

The front and back reinforced corners 162, 164 provide strength and crush resistance, so that a plurality of cartons 160 may generally be stacked on one another without crushing the articles or the other cartons 160. Accordingly, it will be appreciated that in some instances, it may be sufficient to use a lower basis weight and/or lower strength material (e.g., paperboard) to form the carton as compared with a carton without reinforced corners. Further, it will be appreciated that while one configuration of reinforcing flaps 120, 130, 138, 144 is provided herein, other possibilities are contemplated. For example, in another embodiment (not shown), the configuration of flaps may be reversed, so that flaps 138, 144 are interior reinforcing panels and flaps 120, 130 are exterior reinforcing flaps.

The carton 160 also includes a bottom wall 102 and a top wall 168 opposite one another. The various walls 102, 104, 108, 112, 168 define an interior space 172 for receiving one or more containers or articles (not shown).

In some embodiments, the top wall 168 may comprise a partial top wall 168, so that the top wall 168 surrounds or circumscribes an opening 170. Opening 170 may be provided to reduce the total amount of materials (e.g., paperboard) needed to form the carton 160 and/or to allow the articles to be viewed to readily determine the contents of the carton 160. In this example, the opening 170 is substantially rectangular in shape. However, the opening may have any suitable shape, size, and configuration, depending on the need for coverage, the desire to reduce material cost, and numerous other factors. In other embodiments, the opening may be omitted and/or top wall 168 may be provided as a single panel.

In the illustrated embodiment, the top wall 168 comprises a plurality of adjoined end flaps. More particularly, the top wall 168 comprises a front wall end flap 116 foldably joined to the front wall 104 along fold line 118, a back wall end flap 126 foldably joined to the back wall 108 along fold line 128, and a pair of side wall end flaps 134 foldably joined to the side walls 112 along fold line 136. End flaps 116, 126 are joined to an exterior side of end flaps 134 (e.g., along opposite marginal areas of end flaps 134 proximate to fold lines 118, 128), for example, using an adhesive. However, other possibilities are contemplated. For example, in another embodiment (not shown), the configuration of panels may be reversed, so that end flaps 134 may be joined to an exterior surface of end flaps 116, 126 (e.g., along opposite marginal areas of end flaps 116, 126 proximate to fold lines 136).

Still viewing FIG. 1C, the carton 160 also includes a line of disruption 150 extending at least partially across the front wall 104 and side walls 112 to at least partially define a removable portion 174 of the carton. The line of disruption 150 may comprise a kiss cut, as shown (with the interior cut shown in dashed lines), or may comprise any other suitable line of weakening or disruption (e.g. tear line). The line of disruption 150 may be used to transform the carton 160 into a display 160' (e.g., a retail display carton) (FIGS. 1F and 1G) for the articles within the carton, as will be discussed further below.

As shown in FIG. 1C, a first portion 150*a*' of the line of disruption 150 may extend at least partially across the front wall 104, and in this case, extends substantially across the front wall 104 between fold lines 122 through the front reinforced corner areas 162 to define a removable portion of the front wall 104 (i.e., the upper portion of front wall 104 adjacent to fold line 118). Line of disruption 150*a*' lies below the exterior reinforcing flaps 138 on the exterior side of the front wall 104, so that exterior reinforcing flaps 138 are joined only to the removable portion of the front wall 104. In this manner, the exterior reinforcing flaps 138 do not interfere with the separation of the removable portion 174 from the remainder of the carton 160 when the carton is converted to a display carton 160' (FIGS. 1F and 1G).

Line of disruption 150*a*' may be interrupted by access opening 152, which facilitates removal of the removable portion 174 of the carton 160. When the removable portion 174 of the carton 160 is removed, the remaining portion 104'

(FIGS. 1F and 1G) of the front wall 104 (i.e., the lower portion of the front wall 104 adjacent to fold line 106) defines a stop wall of the carton 160', as will be discussed further below.

A second portion 150*b*' of the line of disruption 150 may extend at least partially across each side wall 112 to define a removable portion of each side wall 112. In the illustrated embodiment, lines of disruption 150*b*' may generally extend into the side panels from the ends of line of disruption 150*a*' (disposed generally along fold lines 122) to a top end edge 136 of each side wall 112. More particularly, for each side panel 112, a first portion of line of disruption 150*b*' may extend generally horizontally (or in some cases, slightly obliquely upwardly) into the side panel 112 through the front reinforced corner areas 162 and a second portion of the line of disruption 150*b*' may extend from the first portion of the line of disruption 150*b*' generally vertically (or in some cases obliquely upwardly towards the back wall 108) to the top end edge 136 of the side panel 112, so that each line of disruption 150*b*' is somewhat L-shaped (i.e., generally resembling the capital letter "L"). In some embodiments, the first portion and the second portion of the line of disruption 150*b*' may form an angle $\alpha$ of at least about 90 degrees with respect to one another. However, countless possible configurations are contemplated. Notably, line of disruption 150*b*' (and more specifically, the first portion of line of disruption 150*b*') may be generally aligned with cuts 158 (FIG. 1A) extending at least partially across the interior reinforcing flaps 120 (joined to the interior surface of the side panels 112), so that the reinforcing flaps 120 do not interfere with removal of the removable portion 174 from the carton 160.

As shown in FIG. 1C, lines of disruption 150*b*' may further extend into the top wall 168 to at least partially define a removable portion of the top wall 168. For example, lines of disruption 150*b*' may extend into the side panel end flaps 134 from ends of lines of disruption 150*b*' in the side wall 112 (e.g., generally along fold lines 136) towards the opening 170. More particularly, in the illustrated embodiment, lines of disruption 150*b*' extend obliquely towards the back wall 108 from the top end edge 136 of each side panel 112 to the opening 170. However, other possibilities are contemplated.

A third portion 150*c*' of the line of disruption 150 may extend at least partially across the back wall end flap 126 to at least partially define a removable portion of the top wall 168, and more particularly, to define a removable portion of the back wall end flap 126 adjacent to the opening 170. In this example, line of disruption 150*c*' includes a pair of first portions that extend obliquely generally from lines of disruption 150*b*' in the side panel end flaps 134 towards (but not necessarily abutting) fold line 128, and a second portion that extends between the first portions of lines of disruption 150*c*', substantially parallel to fold line 128, so that the removable portion of the back wall end flap 126 is substantially trapezoidal in shape. However, differently shaped removable portions are contemplated. For example, in another embodiment (not shown), the removable portion of the back wall end flap 126 may be substantially rectangular in shape. Still other possibilities are contemplated.

As stated above, the removable portion 174 of the carton 160, which may include a removable portion of the front wall 104, side walls 112, and, optionally, the top wall 168, may be separated from the carton 160 to define a remaining portion 160' of the carton that serves as a display carton for displaying one or more articles.

Figure 1D:
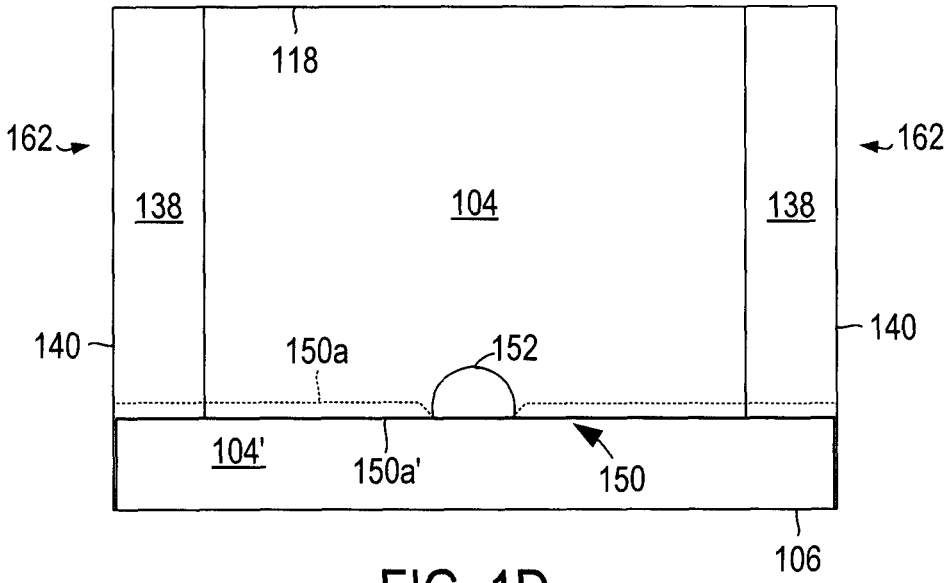
FIGS. 1D and 1E are schematic front and side elevation views of the carton of FIG. 1C, being transformed into a display carton.
Figure 1E:
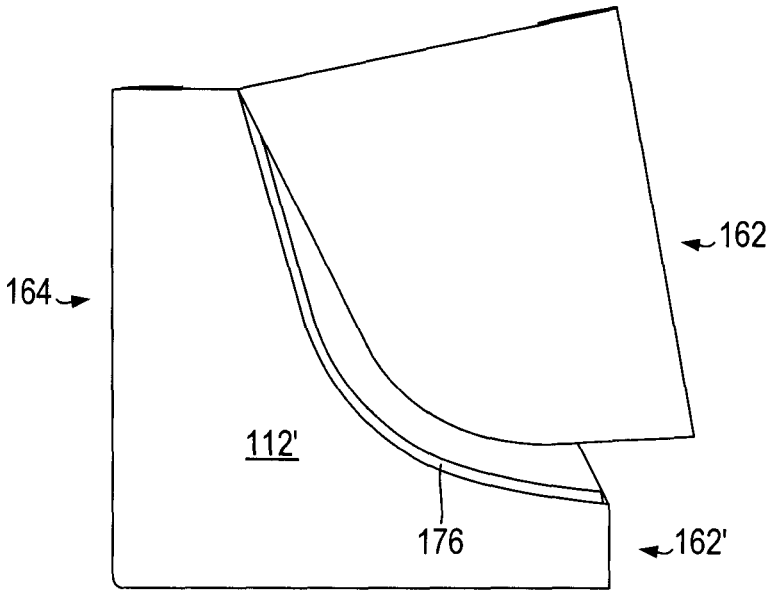
Figure 1F:
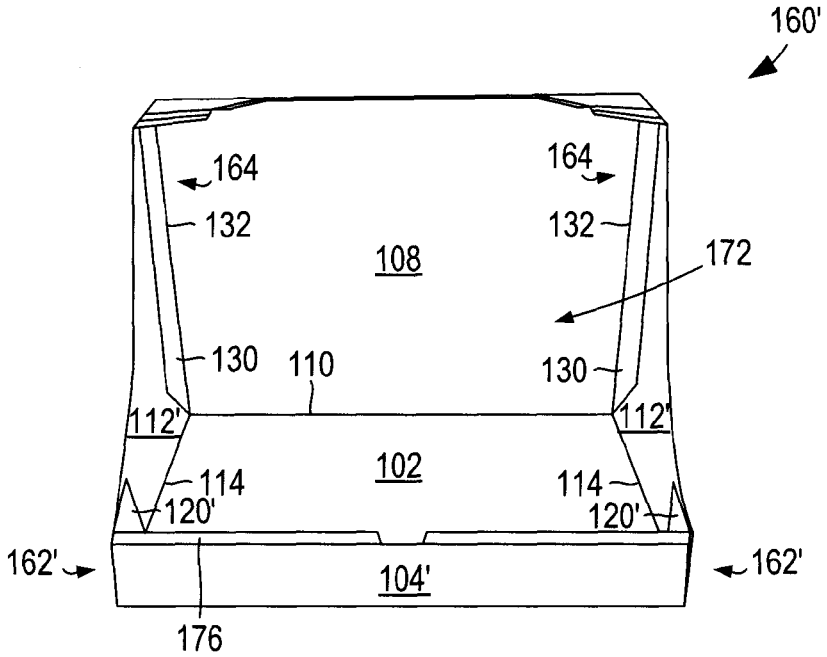
FIGS. 1F and 1G are schematic perspective views a display carton formed from the carton of FIG. 1C.
Figure 1G:
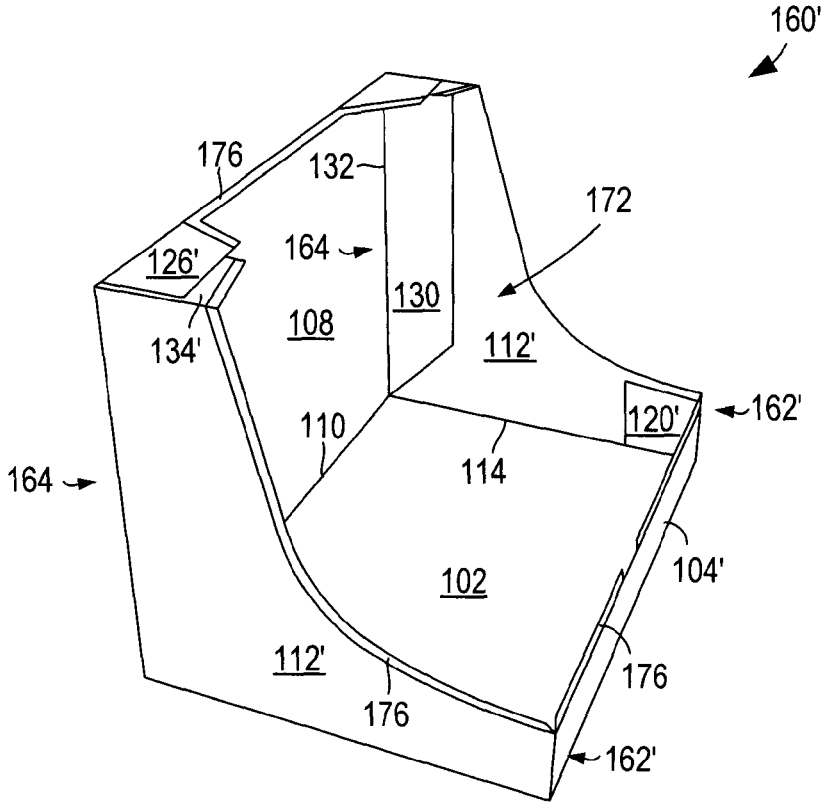

As shown in FIGS. 1D-1G, to transform the carton 160 into a display carton 160' according to one acceptable method, a user may insert a finger or other implement into the access opening 152 and pull the removable portion of the front wall 104 (i.e., the portion above the line of disruption 150*b*') away from the back wall 108 to begin to separate the removable portion 174 from the remainder of the carton 160 along line of disruption 150*a*' (FIG. 1D). The removable portion 174 of the carton 160 then may be lifted away from the bottom wall 102 to tear the removable portion along line of disruption 150*b*' within the side walls 112 and end flaps 134 (FIG. 1E). Finally, the removable portion 174 may be fully separated from the remainder of the carton by separating the removable portion 174 along the line of disruption 150*c*' within the back wall end flap 126 (FIGS. 1F and 1G).

In this configuration, the remainder of the carton serves as a display or display carton 160' for the articles (not shown) within the carton. The bottom panel 102 and back wall 108 serve as a bottom panel 102 and back wall 108 for the display 160'. The remainder 104' of the front wall 104 (i.e., the lower portion 104' of the front wall 104) serves as a stop wall 104' to secure the articles within the display carton 160'. The remaining portions 112' of side walls 112 (generally having an L-shape) extending between the back wall 108 and the remaining front wall (or stop wall) 104' serve as side walls 112' for the display 106'.

Notably, a remaining lower portion 162' of the front reinforced corners 160 (including a portion 120' of flap 120) may provide strength and stability to the stop wall 104'. Likewise, since the back reinforced corners 162 remain intact, the display 160' has sufficient strength to maintain its shape and stability as items are removed and/or inserted into the interior space 172. The remaining portions (e.g., end flap portions 126' and 134') of the top wall 168 also may assist with providing stability and strength to the display carton 160'.

It will be noted that, where the line of disruption 150 comprises a kiss cut (as in the illustrated embodiment), removing the removable portion 174 of the carton 160 reveals the kiss cut area 176 between the kiss cuts on each side of the various carton panels or walls. Since the kiss cut area 176 generally comprises paperboard that has been separated about halfway through its thickness, the kiss cut area 176 is generally soft and/or flexible to the touch. This may be particularly beneficial with a display carton 160' containing articles that may be removed by a user, since any rough edges caused by tearing the removable portion 174 from the remainder of the carton may subject the user to abrasion or injury when grasping the articles within the display.

The removed portion 174 of the carton 160 may be readily flattened by separating the end flaps 116, 134 from one another along glue areas 166.

Although certain embodiments of this invention have been described with a certain degree of particularity, those skilled in the art could make numerous alterations to the disclosed embodiments without departing from the spirit or scope of this invention. All directional references (e.g., upper, lower, upward, downward, left, right, leftward, rightward, top, bottom, above, below, vertical, horizontal, clockwise, and counterclockwise) are used only for identification purposes to aid the reader's understanding of the various embodiments of the present invention, and do not create limitations, particularly as to the position, orientation, or use of the invention unless specifically set forth in the claims. Joinder references (e.g., joined, attached, coupled, connected, and the like) are to be construed broadly and may include intermediate members between a connection of elements and relative movement between elements. As such, joinder references do not necessarily imply that two elements are connected directly and in fixed relation to each other.

It will be understood that in each of the various blanks and trays described herein and contemplated hereby, a "fold line"

can be any substantially linear, although not necessarily straight, form of weakening or disruption that facilitates folding therealong. More specifically, but not for the purpose of narrowing the scope of the present invention, a fold line may be a score line, such as lines formed with a blunt scoring knife, or the like, which creates a crushed portion in the material along the desired line of weakness, a cut that extends partially into a material along the desired line of weakness, and/or a series of cuts that extend partially into and/or completely through the material along the desired line of weakness; or any combination of these features.

For example, one type of conventional tear line is in the form of a series of cuts that extend completely through the material, with adjacent cuts being spaced apart slightly so that a nick (e.g., a small somewhat bridging-like piece of the material) is defined between the adjacent cuts for typically temporarily connecting the material across the tear line. The nicks are broken during tearing along the tear line. Such a tear line that includes nicks can also be referred to as a cut line, since the nicks typically are a relatively small percentage of the subject line, and alternatively the nicks can be omitted from such a cut line.

Furthermore, various exemplary blanks and cartons are shown and described herein as having fold lines, tear lines, score lines, cut lines, kiss cut lines, and other lines as extending from a particular feature to another particular feature, for example from one particular panel to another, from one particular edge to another, or any combination thereof. However, it will be understood that such lines need not necessarily extend between such features in a precise manner. Instead, such lines may generally extend between the various features as needed to achieve the objective of such line. For instance, where a particular tear line is shown as extending from a first edge of a blank to another edge of the blank, the tear line need not extend completely to one or both of such edges. Rather, the tear line need only extend to a location sufficiently proximate to the edge so that the removable strip, panel, or portion can be manually separated from the blank or carton without causing undesirable damage thereto.

Accordingly, it will be readily understood by those persons skilled in the art that, in view of the above detailed description of the invention, the present invention is susceptible of broad utility and application. Many adaptations of the present invention other than those herein described, as well as many variations, modifications, and equivalent arrangements will be apparent from or reasonably suggested by the present invention and the above detailed description thereof, without departing from the substance or scope of the invention as set forth in the following claims.

While the present invention is described herein in detail in relation to specific aspects, it is to be understood that this detailed description is only illustrative and exemplary of the present invention and is made merely for purposes of providing a full and enabling disclosure of the present invention and to provide the best mode contemplated by the inventor or inventors of carrying out the invention. The detailed description set forth herein is not intended nor is to be construed to limit the present invention or otherwise to exclude any such other embodiments, adaptations, variations, modifications, and equivalent arrangements of the present invention.

What is claimed is:

1. A carton comprising:

a plurality of walls including a front wall and a back wall opposite one another, and a first side wall and a second side wall opposite one another, wherein the front wall and back wall are joined to the first side wall and second side wall along reinforced corner areas, each of the reinforced corner areas includes an exterior reinforcing flap and an interior reinforcing flap, each exterior reinforcing flap being in face-to-face contact with at least one of the front wall and the back wall; and a line of disruption extending at least partially across the front wall, first side wall, and second side wall, wherein the line of disruption at least partially defines a removable portion of the carton.

2. The carton of claim 1, comprising:

a first exterior reinforcing flap and a second exterior reinforcing flap foldably connected to the first side wall, and a third exterior reinforcing flap and a fourth exterior reinforcing flap foldably connected to the second side wall, wherein the first exterior reinforcing flap and the second exterior reinforcing flap are in face-to-face contact with the exterior surface of the front wall, and the third exterior reinforcing flap and the fourth exterior reinforcing flap are in face-to-face contact with the exterior surface of the back wall.

3. The carton of claim 2, wherein the first exterior reinforcing flap and the second exterior reinforcing flap are adhesively joined to the exterior surface of the front wall, and the third exterior reinforcing flap and the fourth exterior reinforcing flap are adhesively joined to the exterior surface of the back wall.

4. The carton of claim 2, wherein the line of disruption extending at least partially across the front wall defines a removable portion of the front wall, and the first exterior reinforcing flap and the second exterior reinforcing flap are adhesively joined only to the removable portion of the front wall.

5. The carton of claim 1, comprising:

a first interior reinforcing flap and a second reinforcing flap foldably connected to the front wall, and a third interior reinforcing flap and a fourth reinforcing flap foldably connected to the back wall, wherein the first interior reinforcing flap and the second interior reinforcing flap are joined to the interior surface of the first side wall, and the third interior reinforcing flap and the fourth interior reinforcing flap are joined to the interior surface of the second side wall.

6. The carton of claim 5, wherein the first interior reinforcing flap and the second interior reinforcing flap are adhesively joined to the interior surface of the first side wall, and the third interior reinforcing flap and the fourth interior reinforcing flap are adhesively joined to the interior surface of the second side wall.

7. The carton of claim 1, wherein the line of disruption extending at least partially across the first side wall extends from the front wall to a top end edge of the first side wall, and the line of disruption extending at least partially across the second side wall extends from the front wall to a top end edge of the second side wall.

8. The carton of claim 7, wherein the line of disruption extending at least partially across the first side wall includes a first portion that extends substantially horizontally from the front wall into the first side wall, and a second portion that extends from the first portion to the top end edge of the first side wall, the line of disruption extending at least partially across the second side wall includes a first portion that extends substantially horizontally from the front wall into the second side wall, and a second portion that extends from the first portion to the top end edge of the second side wall.

9. The carton of claim 7, wherein for each of the line of disruption extending at least partially across the first side wall and the line of disruption extending at least partially across the second side wall, the first portion and the second portion of the respective line of disruption define a somewhat L shape.

10. The carton of claim 7, wherein for each of the line of disruption extending at least partially across the first side wall and the line of disruption extending at least partially across the second side wall, the first portion and the second portion of the respective line of disruption form an angle of at least about 90 degrees with respect to one another.

11. The carton of claim 1, further comprising an aperture adjacent to the line of disruption extending at least partially across the front wall.

12. The carton of claim 11, wherein the plurality of walls includes a top wall comprising a plurality of end flaps, the plurality of end flaps including a first side wall end flap foldably connected to the first side wall and a second side wall end flap foldably connected to the second side wall.

13. The carton of claim 12, wherein the line of disruption extends at least partially across the first side wall end flap and the second side wall end flap.

14. The carton of claim 13, wherein the line of disruption extending at least partially across the first side wall end flap extends obliquely from the first side wall towards the back wall, and the line of disruption extending at least partially across the second side wall end flap extends obliquely from the second side wall towards the back wall.

15. The carton of claim 12, wherein the plurality of end flaps further includes a back wall end flap foldably connected to the back wall.

16. The carton of claim 15, wherein the line of disruption extends at least partially across the back wall end flap.

17. The carton of claim 16, wherein the line of disruption extending at least partially across the back wall end flap includes a pair of first portions that extend obliquely from the side panel end flaps towards one another, and a second portion that extends between the pair of first portions.

18. The carton of claim 1, wherein the plurality of walls further includes a top wall and a bottom wall opposite one another.

19. The carton of claim 18, wherein the line of disruption extends at least partially across the top wall.

20. The carton of claim 18, wherein the top wall surrounds an opening.

21. The carton of claim 20, wherein the opening is substantially rectangular in shape.

22. The carton of claim 1, wherein the removable portion of the carton is for being removed from the carton to define a remaining portion of the carton, the remaining portion of the carton being operative as a display carton.

23. The carton of claim 22, wherein the display carton comprises the back wall, a lower portion of the front wall, and a portion of each of the first side panel and the second side panel extending between the back wall and the lower portion of the front wall.

24. The carton of claim 23, wherein the portion of each of the first side panel and the second side panel extending between the back wall and the lower portion of the front wall is substantially L-shaped.

25. The carton of claim 1, wherein the line of disruption comprises a pair of offset kiss cuts that extend along one another on opposite sides of the front wall, first side wall, and second side wall.

26. A carton comprising:

a plurality of walls including a bottom wall, a front wall and a back wall opposite one another, and a first side wall and a second side wall opposite one another, wherein the front wall, back wall, first side wall, and second side wall each have an interior surface and an exterior surface;

a plurality of reinforcing flaps including a first pair of reinforcing flaps foldably connected to the front wall, a second pair of reinforcing flaps foldably connected to the back wall, a third pair of reinforcing flaps foldably connected to the first side wall, and a fourth pair of reinforcing flaps foldably connected to the second side wall, wherein the first pair of reinforcing flaps and the second pair of reinforcing flaps are adhesively joined to the interior side of the first side wall and the second side wall, and the third pair of reinforcing flaps and the fourth pair of reinforcing flaps are adhesively joined to the exterior side of the front wall and the back wall; and a line of disruption extending at least partially across each of the first side wall, second side wall, and front wall, wherein the line of disruption defines a removable portion of the carton.

27. A blank for forming a carton, the blank comprising:

a plurality of panels including a bottom panel, a front panel and a back panel foldably connected to the bottom panel and opposite one another, and a first side panel and a second side panel foldably connected to the bottom panel and opposite one another, wherein the front panel and back panel are configured to join to the first side panel and the second side panel forming reinforced corner areas when the blank is formed into a carton, a first exterior reinforcing flap and a second exterior reinforcing flap foldably connected to the first side panel, and a third exterior reinforcing flap and a fourth exterior reinforcing flap foldably connected to the second side panel, wherein the first exterior reinforcing flap and the second exterior reinforcing flap are configured to be in face-to-face contact with the exterior surface of the front panel when the blank is formed into a carton, and the third exterior reinforcing flap and the fourth exterior reinforcing flap configured to be in face-to-face contact with the exterior surface of the back panel when the blank is formed into a carton, a line of disruption extending at least partially across the front panel, first side panel, and second side panel, wherein the line of disruption at least partially defines a removable portion of the carton when the blank is formed into the carton.

* * * * *